United States Patent [19]

Looney

[11] 4,408,402

[45] Oct. 11, 1983

[54] SUPPORTIVE SHOE AND INSERT

[76] Inventor: Judy A. Looney, 10112 Watkins Mill Pl., Gaithersburg, Md. 20879

[21] Appl. No.: 405,364

[22] Filed: Aug. 5, 1982

[51] Int. Cl.[3] ..... A43B 13/38; A43B 13/42

[52] U.S. Cl. ..... 36/43; 36/44; 36/71; 36/91; 36/92

[58] Field of Search ..... 128/583, 614, 584, 595; 36/32 R, 31, 91, 92, 43, 71, 69, 44

[56] References Cited

U.S. PATENT DOCUMENTS

| | | | |
|---|---|---|---|
| 2,348,300 | 5/1944 | Klaus | 128/614 |
| 3,601,908 | 8/1971 | Gilkerson | 36/43 |

FOREIGN PATENT DOCUMENTS

| | | | |
|---|---|---|---|
| 1000716 | 1/1957 | Fed. Rep. of Germany | 36/43 |
| 771773 | 4/1957 | United Kingdom | 36/43 |

*Primary Examiner*—Werner H. Schroeder
*Assistant Examiner*—Steven N. Meyers
*Attorney, Agent, or Firm*—Haight & Associates

[57] ABSTRACT

A shoe or shoe insert is described which provides increased support to specific areas of the foot during the first and second trimesters and third trimester of pregnancy to compensate for changes in body weight and center of gravity which occurs as the term of pregnancy advances. A pad, which can be a shoe insole, is provided with these specific areas of support.

8 Claims, 4 Drawing Figures

SUPPORTIVE SHOE AND INSERT

TECHNICAL FIELD OF THE INVENTION

The present invention relates to a shoe insert and/or shoe specifically adapted to provide enhanced comfort and support during pregnancy. More specifically, the present invention relates to shoe inserts and/or shoes which provide enhanced support respectively during the first and second trimester and third trimester of pregnancy by taking into account and compensating for the shift in body weight and posture associated with pregnancy.

BACKGROUND OF THE INVENTION

One of the major changes which many pregnant women experience is largely due to an alteration in the center of gravity of their body which shifts because of a gain in weight and the change in the circumference of the torso. During pregnancy the natural curves in the backbone become more pronounced as the body's weight increases and its center of gravity moves forward in relation to the spine. Increased stress causes the pelvis to tip forward and the posture to be poor which commonly results in fatigue and backache since the back muscles are forced to do work for which they were not designed. The more S-shaped the spinal column becomes the more these muscles are taxed. Pregnancy further jeopardizes the vulnerable pelvic floor because of the increased weight it must support as the uterus enlarges. Like a bow string, the back muscles tend to shorten as the abdominal muscles lengthen. Further, during pregnancy, as a result of the shift of the center of gravity, the pregnant woman tends to stand further back on her heels. Further compensation may occur such as bringing the head and shoulders forward, raising the lumbar curve or swaying back from the waist. Backache commonly results from this incorrect weight distribution since the muscles of the back are now doing extra work.

Although it has been recognized that comfortable shoes which provide generally adequate support are especially important as the pregnancy advances, the kinds of shoes which are actually worn by pregnant women frequently contribute to the problem rather than alleviating it. For example, high heel shoes throw the pelvis and body weight forward, which hollows the back and strains ligiments in the hip and knees. Because of this unstable position, the muscles have to work much harder and the weight on the toes may cause the arches and balls of the feet to experience discomfort. Other styles of shoes, for example with the negative heel, stretch these muscles even more than flats and frequently become uncomfortable.

DISCLOSURE OF THE INVENTION

It is accordingly a general object of the present invention to provide shoes or shoe inserts specifically adapted to compensate for the change of body weight and center of gravity which occurs in pregnant women as their pregnancy advances.

A further object of the present invention is to provide shoes and shoe inserts which provide the necessary comfort and support to women during their advancing pregnancy.

An additional object of the present invention is to provide a shoe and a shoe insert specifically adapted to provide comfortable and adequate support during the first and second trimesters of pregnancy and an additional shoe and shoe insert to provide such comfort and support during the third trimester of pregnancy.

Upon study of the specification and appended claims, further objects, features and advantages of the present invention will become more fully apparent to those skilled in the art to which this invention pertains.

BEST MODE FOR CARRYING OUT THE INVENTION

Brifely, the above and other objects, features and advantages of the present invention are realized in one aspect thereof by providing shoe inserts and/or shoes specifically adapted to compensate for changing body weight and center of gravity during respectively the first and second trimesters of pregnancy and the third trimester of pregnancy.

Figure 1:
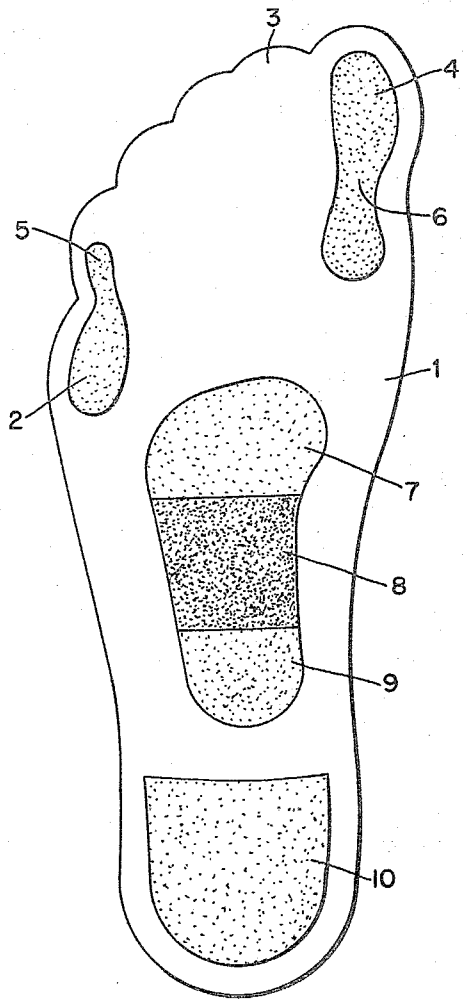
FIG. 1 is a top view showing the shoe insert or interior sole of a shoe of the present invention for use during the first and second trimesters of pregnancy.

Directing attention to FIG. 1, a pad 1 suitable for insertion during the first and second trimester of pregnancy into a shoe or alternatively the interior sole of a shoe is illustrated. This insert pad or inner sole can be of any suitable flexible material commonly employed for such purposes such as leather, a resilient foam-like material, or various combinations of materials. This pad or insole is provided with a series of specific areas of increased rigidity and support. Preferably these areas of greater rigidity and support can be integral with the basic pad or inner sole itself in that they do not extend above the plane of the pad or inner sole. The area 2 of the pad 1 on which the little toe and ball of the little toe rest is provided with moderate support 5 which is substantially less flexible than the overall pad 1 but not completely rigid. Similar areas of moderate rigidity and support are provided at 6 under the big toe 4 and the ball of the big toe. Further moderate support is provided by a moderately rigid are a 10 under the heel. An area of maximum support 8 is provided directly under the arch by stiffening the region so that it is essentially inflexible. Areas of moderate rigidty and support 7 and 9 extend away from this area of maximum support so that the entire area 7, 8 and 9 under the arch is provided with a gradually increased degree of support toward the center of the arch. It will be understood that by moderate rigidity and support it is meant that the area so defined is less flexible and therefore more supportive than the surrounding pad without being as essentially inflexible as the defined areas of maximum support.

Generally, in accordance with this aspect of the present invention, a total of about 30 to 40 percent area of the entire insert pad or inner sole is provided with enhanced rigidity and support for the foot during the first and second trimesters of pregnancy. Approximately 2 to 5 percent of this area is located beneath the little toe and ball, about 3 to 5 percent is located beneath the big toe and ball, about 15 to 20 percent in the entire area under the arch with about one-third of the area under the arch having the maximum support afforded by an essentially inflexible supportive area, and about 10 to 15 percent of the total area of the insert pad is supported in the heel.

Increased rigidity and support in the indicated areas can be accomplished in a number of ways in accordance with the present invention. For example, where a porous material is employed for the flexible foot pad, impregnation by a suitable plastic material which hardens to the desired degree of rigidity can be used. Additionally, other stiffening techniques and means can be used to provide the required degree of support and rigidity. One way for example of providing the additional rigidity required directly under the arch is to employ a greater thickness of stiffening material than is employed under the big and little toe and heel and in the larger surrounding arch area. To enhance the comfort without detracting from the essential support provided in accordance with the present invention, it may also be desirable to provide a thin soft resilient covering such as a foam or cloth material over the insert and particularly those areas whose rigidity has been increased to provide support.

Figure 2:
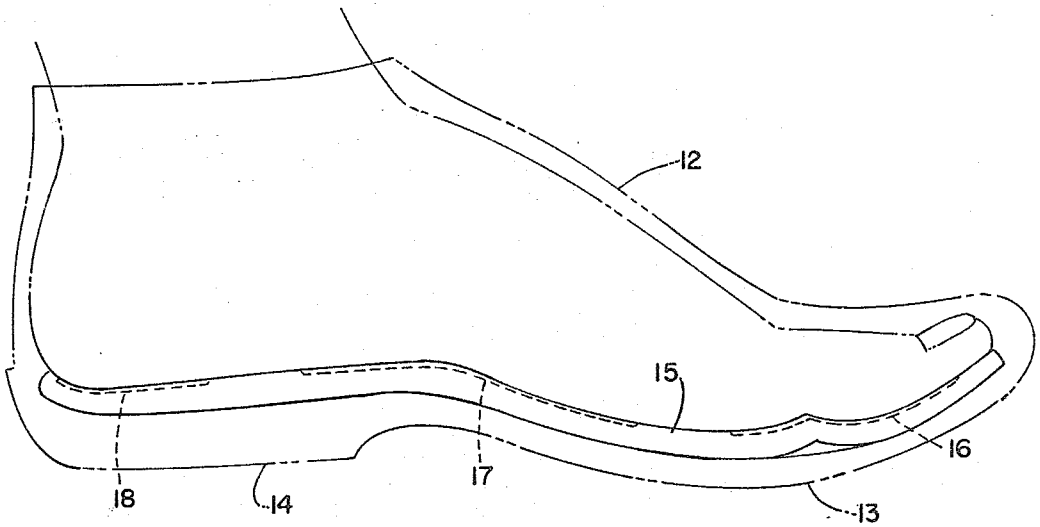
FIG. 2 is a side view cutaway of a shoe illustrating the areas of support provided by the present invention during the first and second trimesters of pregnancy.

FIG. 2 illustrates through a side cutaway view the enhanced areas of support provided for example in a shoe by the pad or insole of the present invention. A shoe 12 is shown having a sole 13 and heel 14. The inner sole 15 is provided with reinforced areas of support 16, 17 and 18 which correspond respectively to areas 6, 7, 8, 9 and 10 described with respect to the pad or insole in FIG. 1. An area of support under the little toe corresponding to area 5 in FIG. 1 is provided but not shown. In the instance of a shoe, the reinforced pad can actually be the insole of the shoe.

The support system of the present invention therefore provides enhanced support in those areas of the foot which experience the weight shift associated with the first and second trimesters of pregnancy. In particular, the weight which normally is largely placed on the toe 3 adjacent to the big toe shifts to the big toe and ball of the big toe during this period. During the third trimester of pregnancy the woman's weight increases somewhat and the center of gravity of the woman shifts forward thereby necessitating an increase in weight toward the back of the shoe to compensate for this forward shift.

Figure 3:
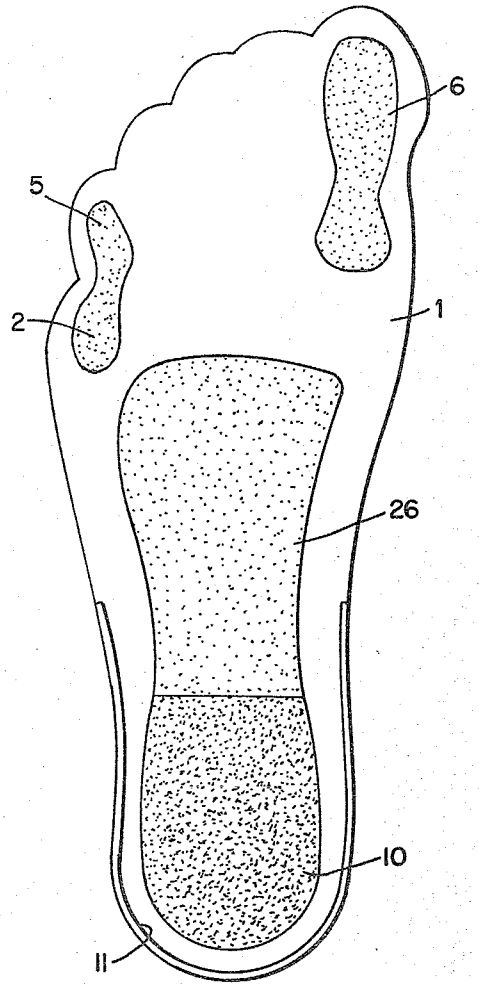
FIG. 3 is a top view of an insert or interior sole of the present invention for use during the third trimester of pregnancy.

Directing attention to FIG. 3 of the drawings, it will be seen that the inner sole or pad of the present invention which is specifically designed to compensate for these changes in weight and center of gravity during the third trimester has essentially the same flexible pad or inner sole 1 described with respect to the earlier terms of pregnancy. The degree of support and flexibility under the little toe and adjoining ball area 2 is essentially the same as that described with regard to the first and second trimesters of pregnancy. The area 6 under the big toe and ball however is increased to have greater rigidity and support to compensate for the increased weight which is now borne by this area of the foot. An area of maximum rigidity which is essentially inflexible and provides maximum support is now in the heel area 10 but decreases across the arch to the area 26 in its extent of inflexibility and degree of support. This additional support and rigidity in the heel is provided to compensate for this tendency of the woman to shift her weight to the heel area to counteract the forward thrust of body weight in the pelvic region. In addition, a heel counter of similar rigid material providing enhanced support is provided around the periphery of the heel portion of the pad 1 as shown at 11. This rigid counter can be provided for example with stiff leather, synthetic material or other materials known for imparting stiffness to shoes. As in the insert and insole described with regard to the first and second trimesters of pregnancy, the insole and pad for use during the third trimester of pregnancy can also advantageously be covered with a soft, resilient material to provide added comfort for the wearer.

Figure 4:
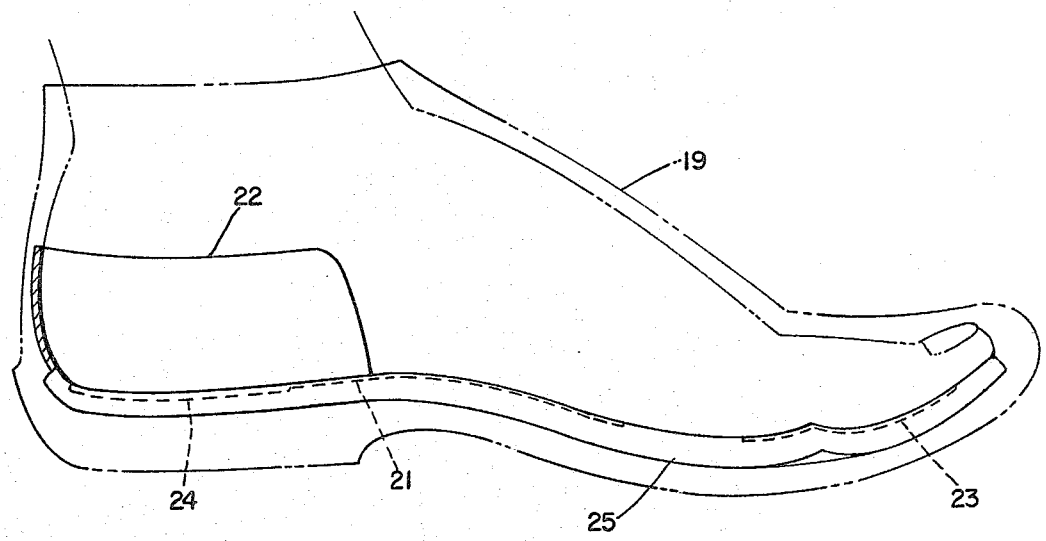
FIG. 4 is a side view cutaway of a shoe illustrating the areas of support provided in accordance with the present invention during the third trimester of pregnancy.

FIG. 4 illustrates by a cutaway view of a shoe 19 the additional support provided in inner sole 25 to the heel 24, arch 21 and toe areas 23 during the third trimester of pregnancy as described in FIG. 3 and corresponding respectively to areas 10, 26 and 6. A heel counter 22 corresponds to the counter 11 in FIG. 3. It will be apparent from the illustrations in FIG. 2 and 4 that the supportive areas employed in the present invention are advantageously contoured to the respective portions of the foot which they will engage.

It will further be apparent to those of ordinary skill in the art that various known materials and modes of construction can be employed in accordance with the present invention and that various modifications of the present invention can be made without departing from the scope of the claims appended hereto.

I claim:

1. A shoe insert to provide increased support during the first and second trimesters of pregnancy comprising a flexible pad adapted to extend substantially beneath the entire foot from heel to toe, said pad having integrated therewith foot support means comprising areas of greater rigidity than the rest of said flexible pad, said foot support means comprising a substantial inflexible area of maximum support in the arch and individual areas of moderate flexibility and support (1) in the heel, (2) extending from the arch area of maximum support toward the heel and toes, and (3) extending from the big and little toes under their respective ball areas.

2. A shoe insert to provide increased support during the third trimester of pregnancy comprising a flexible pad adapted to extend substantially beneath the entire foot from heel to toe, said pad including foot support means integral therewith and comprising respective areas of greater rigidity than the rest of said flexible pad, said areas of greater rigidity comprising a substantially inflexible area of maximum support in the heel with continuous areas of gradually diminishing rigidity extending from said heel area to an area of moderate flexibility and support in the arch, an additional area of moderate flexibility and support extending under the little toe and ball, and an area of substantial rigidity and support extending under the big toe and ball.

3. The shoe insert of claim 2 which includes an essentially inflexible counter means enclosing said heel area and providing additional support.

4. The shoe insert of claim 2 wherein about 35 to 55 percent of the total weight of the insert is in the heel portion.

5. A shoe for providing increased support during the first and second trimesters of pregnancy comprising an upper attached to a sole portion having a heel, arch and toe areas, said sole being flexible and including foot support means integral therewith and comprising a flexible pad adapted to extend substantially beneath the entire foot from heel to toe, said pad having integrated therewith foot support means comprising areas of greater rigidity than the rest of said flexible pad, said foot support means comprising a substantially inflexible area of maximum support in the arch and individual areas of moderate flexibility and support (1) in the heel, (2) extending from the arch area of maximum support toward the heel and toes, and (3) extending from the big and little toes under their respective ball areas.

6. A shoe for providing increased support during the third trimester of pregnancy comprising an upper attached to a sole portion having heel, arch and toe areas, said sole being flexible and including foot support means integral therewith and comprising a flexible pad adapted to extend substantially beneath the entire foot from heel to toe, said pad including foot support means integral therewith and comprising respective areas of greater rigidity than the rest of said flexible pad, said areas of greater rigidity comprising a substantially inflexible area of maximum support in the heel with continuous areas of gradually diminishing rigidity extending from said heel area to an area of moderate flexibility and support in the arch, an additional area of moderate flexibility and support extending under the little toe and ball, and an area of substantial rigidity and support extending under the big toe and ball.

7. The shoe method of claim 6 including an essentially inflexible counter means enclosing said heel area and providing additional support.

8. A method for providing increased foot support during pregnancy which comprises providing during the first and second trimesters of pregnancy a pad or insole for a shoe having maximum support and rigidity in the arch and moderate rigidity and support in the heel, the areas of the big and little toes and their respective balls, and extending from the arch toward the toes and heel; and during the third trimester of pregnancy providing a pad or insole for a shoe having maximum support and rigidity in the area of the big toe and ball and in the heel extending to an area of moderate support and rigidity in the arch, and an area of moderate rigidity and support under the little toe and ball, with substantially inflexible counter means provided around the heel.

* * * * *